US012473127B2

(12) United States Patent
Smith et al.

(10) Patent No.: US 12,473,127 B2
(45) Date of Patent: Nov. 18, 2025

(54) DISPLAY CONTAINER

(71) Applicant: All Plastic, Inc., Rancho Cordova, CA (US)

(72) Inventors: William Thomas Smith, Fair Oaks, CA (US); Cheryl Ann Smith, Fair Oaks, CA (US)

(73) Assignee: All Plastic, Inc., Rancho Cordova, CA (US)

( * ) Notice: Subject to any disclaimer, the term of this patent is extended or adjusted under 35 U.S.C. 154(b) by 484 days.

(21) Appl. No.: 17/975,972

(22) Filed: Oct. 28, 2022

(65) Prior Publication Data

US 2023/0045872 A1 Feb. 16, 2023

Related U.S. Application Data

(60) Continuation of application No. 29/786,089, filed on May 28, 2021, now Pat. No. Des. 968,216, which is (Continued)

(51) Int. Cl.

| | |
|---|---|
| ***B65D 51/16*** | (2006.01) |
| ***B65D 25/54*** | (2006.01) |
| ***B65D 43/02*** | (2006.01) |

(52) U.S. Cl.

CPC ..... *B65D 51/1683* (2013.01); *B65D 25/54* (2013.01); *B65D 43/0202* (2013.01); *B65D 2543/00092* (2013.01)

(58) Field of Classification Search

CPC ..... B65D 51/1633; B65D 51/1672; B65D 51/16; B65D 25/54; B65D 43/02; (Continued)

(56) References Cited

U.S. PATENT DOCUMENTS

| | | | |
|---|---|---|---|
| D128,936 | S | 8/1941 | Foley |
| D181,321 | S | 10/1957 | Stowell |

(Continued)

FOREIGN PATENT DOCUMENTS

| | | |
|---|---|---|
| EP | 1779885 | 5/2007 |

OTHER PUBLICATIONS

Bud Bar Displays, facebook publication dated Oct. 22, 2016 retrieved from <https://www.facebook.com/BudBarDisplays/photos/a.1250515684990657/1251440661564826/?type=3&theater>.

(Continued)

*Primary Examiner* — Javier A Pagan
(74) *Attorney, Agent, or Firm* — Ballard Spahr LLP

(57) ABSTRACT

A display container includes an enclosure having a container body and a lid mounted to the container body for enclosing an interior chamber of the enclosure. The lid has an integrated lens positioned over the interior chamber and a plurality of ports extending through the lid adjacent the lens. The display container further includes a slide valve assembly for selectively opening and closing the ports. The slide valve assembly includes a track fixed relative to the lid in alignment with the ports, and a slide plate slidably received in the track. The slide plate is slidable back and forth along the track between a first position in which the slide plate blocks the ports and a second position in which the ports are unblocked.

21 Claims, 7 Drawing Sheets

Related U.S. Application Data a division of application No. 29/669,649, filed on Nov. 9, 2018, now Pat. No. Des. 923,475.

(58) Field of Classification Search

CPC ..... B65D 43/0202; A47F 7/28; A47F 7/286; A47F 3/14; A47F 3/145; A24F 23/00

See application file for complete search history.

(56) References Cited

U.S. PATENT DOCUMENTS 2,807,901 A 10/1957 Gilowitz
3,247,995 A 4/1966 Jensen
D215,413 S 9/1969 Donovan et al.
3,656,840 A 4/1972 Smith et al.
D234,343 S 2/1975 Schick et al.
4,106,660 A 8/1978 Boyle
D255,546 S 6/1980 Zaidmann et al.
4,230,231 A 10/1980 Burnett et al.
4,284,200 A 8/1981 Bush et al.
D272,595 S 2/1984 Chase et al.
D283,099 S 3/1986 Shabram, Sr. et al.
D292,887 S 11/1987 Schouten
D303,428 S 9/1989 Wada et al.
4,979,332 A 12/1990 Nagaya et al.
D322,323 S 12/1991 Moir
D340,187 S 10/1993 Forsyth
5,321,908 A 6/1994 Ushimaru
D351,906 S 10/1994 Marsh
5,363,801 A 11/1994 Watters et al.
5,927,007 A 7/1999 Oda et al.
6,013,524 A 1/2000 Friars et al.
D455,552 S 4/2002 Charness
6,571,972 B1 6/2003 Bouc et al.
D476,572 S 7/2003 Merritt
D480,307 S 10/2003 Canamasas Puigbo
6,761,287 B2 7/2004 Caruso
D493,721 S 8/2004 Puigbo
D493,722 S 8/2004 Cooper
D513,979 S 1/2006 Snedden et al.
D517,405 S 3/2006 Snedden et al.
D518,728 S 4/2006 Frantz
D523,752 S 6/2006 Bried et al.
7,185,827 B2 3/2007 Quintard et al.
D547,177 S 7/2007 Sherman et al.
D588,450 S 3/2009 Snedden et al.
D590,706 S 4/2009 Doliwa et al.
D591,148 S 4/2009 Parikh et al.
D600,111 S 9/2009 Gerulski et al.
D621,603 S 8/2010 Traylor
D630,949 S 1/2011 Lim
D646,969 S 10/2011 Snedden et al.
D647,530 S 10/2011 Busch
8,079,478 B2 12/2011 Short et al.
D655,604 S 3/2012 Molina et al.
D671,831 S 12/2012 Moreau
D685,227 S 7/2013 Boonprasop
8,544,208 B2 10/2013 Huang
D696,948 S 1/2014 Kim
D702,547 S 4/2014 Akana
D703,055 S 4/2014 Park
D708,903 S 7/2014 Wong
8,925,725 B1 1/2015 Burnett
D731,891 S 6/2015 Servaire
D749,381 S 2/2016 Magri
D765,389 S 9/2016 Martin
D769,079 S 10/2016 Kotani
D775,959 S 1/2017 Owen
D778,718 S 2/2017 Smith et al.
9,630,747 B2 4/2017 Smith et al.
D794,944 S 8/2017 Martin
D806,543 S 1/2018 Finkbohner et al.
D812,939 S 3/2018 Modlin
D814,831 S 4/2018 Modlin
9,981,790 B1 5/2018 Ost
D821,738 S 7/2018 Small
D830,779 S 10/2018 Li et al.
D842,494 S 3/2019 Lee
D849,526 S 5/2019 Sanders et al.
D855,449 S 8/2019 Smith et al.
10,384,834 B2 8/2019 Smith et al.
D859,894 S 9/2019 Smith et al.
D861,475 S 10/2019 Giwani
D862,226 S 10/2019 Horn
D863,053 S 10/2019 Smith et al.
D866,334 S 11/2019 Wieland
D870,507 S 12/2019 Whaley et al.
D876,945 S 3/2020 Smith et al.
D877,930 S 3/2020 Santamarta
D878,120 S 3/2020 Smith
D878,826 S 3/2020 Smith
D887,843 S 6/2020 Smith et al.
D891,253 S 7/2020 Smith
D899,920 S 10/2020 Smith et al.
D902,028 S 11/2020 Smith et al.
D902,718 S 11/2020 Smith et al.
D904,185 S 12/2020 Smith
D904,883 S 12/2020 Diaz
D908,484 S 1/2021 Smith et al.
D909,872 S 2/2021 Smith et al.
D914,412 S 3/2021 Angeles
D918,050 S 5/2021 Smith
11,001,413 B2 5/2021 Smith
D920,782 S 6/2021 Smith
D922,198 S 6/2021 Smith et al.
D922,866 S 6/2021 Kaye
D922,870 S 6/2021 Smith et al.
D923,475 S 6/2021 Smith
D926,036 S 7/2021 Smith
D930,471 S 9/2021 Smith
11,235,909 B2 2/2022 Smith
2003/0234208 A1 12/2003 Huang
2005/0092751 A1 5/2005 Alvares et al.
2007/0051826 A1* 3/2007 Schofield ..... A61L 9/03 239/57
2007/0187406 A1 8/2007 Nobile et al.
2009/0057326 A1 3/2009 Opitz
2009/0261100 A1 10/2009 McMinn
2010/0300370 A1 12/2010 Hundt
2013/0313217 A1 11/2013 Yamamoto et al.
2016/0031605 A1* 2/2016 Bean ..... B65D 85/70 206/1.5
2016/0257458 A1 9/2016 Pentelovitch et al.
2016/0318672 A1 11/2016 Smith et al.
2017/0190482 A1 7/2017 Smith et al.
2017/0275075 A1 9/2017 Bamonte et al.
2018/0016065 A1 1/2018 Ho
2018/0362215 A1 12/2018 Whetsel et al.
2019/0009967 A1 1/2019 Lung
2019/0152648 A1 5/2019 Parve et al.
2020/0113353 A1* 4/2020 Bigioni ..... A47F 7/286
2020/0130901 A1 4/2020 Kern
2020/0307875 A1 10/2020 Abbasi
2020/0361661 A1 11/2020 Smith
2022/0089326 A1 3/2022 Smith et al.

OTHER PUBLICATIONS

Magazine AD for Bud Bar Displays™. 3rd Annual Marijuana Business Conference & Expo, Las Vegas, NV, Nov. 1, 2014. 3 pages.
Magazine AD for Bud Bar Displays™. Canna Con, Denver, Colorado, Jun. 1, 2015. 3 pages.
Magazine AD showing Bud Bar Displays™. Dope Magazine, Issue #7, Dec. 1, 2015. 2 pages.
Magazine AD for Bud Bar Displays™. MG-Magazine.com, Feb. 1, 2016. 2 pages.
Magazine AD for Bud Bar Displays™. Marijuana Business Magazine, vol. 2, Issue 4, Jul. 1, 2015. 2 pages.
Magazine AD for Bud Bar Displays™. Marijuana Venture Magazine, Jun. 1, 2017. 3 pages.
Magazine AD for Bud Bar Displays™. Marijuana Venture Magazine, Nov. 1, 2017. 3 pages.

(56) References Cited

OTHER PUBLICATIONS

Magazine AD for Bud Bar Displays™. Marijuana Venture Magazine, vol. 1, Issue 7, Sep. 1, 2014. 3 pages.
Magazine AD for Bud Bar Displays™. The News Tribune, Aug. 15, 2014. 2 pages.
Pictures of Bud Bar Displays™ booth at the KushCon Convention, which features the Epods. Denver, Colorado, Dec. 1, 2010. 3 pages.
Website photo. cannabisaroma cannapod. www.budbardisplays.com. Published Jan. 23, 2016.
Website photo. Bud-Pod. www.budbardisplays.com. Published Jan. 1, 2016.
Website photo. BadBar. www.budbardisplays.com. Published Jan. 23, 2016.
Website photo. Aroma epod. www.budbardisplays.com. Published Jan. 23, 2016.
Website photo. Highlight display. www.budbardisplays.com. Published Jan. 23, 2016.
Website photo. 3 Tier Lighted Display. www.budbardisplays.com. Published Jul. 9, 2017.
Website photo. Bud bar cabinet. www.budbardisplays.com. Published Jul. 9, 2017.
Website photo. Budtender1. www.budbardisplays.com. Published Jul. 9, 2017.
Website photo. Canna pod. www.budbardisplays.com. Published Jul. 9, 2017.
Website photo. Eco Pod Cabinet. www.budbardisplays.com. Published Jul. 9, 2017.
Website photo. Bud Pod. www.budbardisplays.com. Published Jul. 9, 2017.
Website photo. e-Pod. www.budbardisplays.com. Published Jul. 9, 2017.
Website photo. Sample pod package. www.budbardisplays.com. Published Jul. 9, 2017.
Website photo. Security seals for pods. www.budbardisplays.com. Published Jul. 9, 2017.
Website photo. Tether on Bud Pod3. www.budbardisplays.com. Published Jul. 9, 2017.
Bud Pod and Bud pod security tether close up. Publication on Facebook Oct. 21, 2016. https://www.facebook.com/BudBarDisplays/photos/a.1250515684990657/1250523611656531/?type=3&theater.
Budtender Demo-Bud Bar Displays. Publication on youtube dated May 7, 2017—https://www.youtube.com/watch?v=JRd6B1ZXZlk.
Facebook post showing sample containers, Oct. 22, 2016. https://www.facebook.com/BudBarDisplays/photos/a.1250515684990657/1251439121564980/?type=3&theater.
Facebook post showing sample containers, Oct. 22, 2016. https://www.facebook.com/BudBarDisplays/photos/a.1250515684990657/1251439121564980/?type=3&theater (continued).
Author Unknown; Bud Pod Seals Airtight for Freshness; Published Sep. 14, 2018; retrieved Nov. 5, 2019 from www.budbardisplays.com/producs/pods/budpod.
Pictures of Bud Bar Displays™ booth at the KushCon Convention, which features the Bud Pod. Denver, Colorado, Dec. 1, 2010. 3 pages (color).
Website photo. Epod. www.budbardisplays.com. Published Jul. 1, 2013.

* cited by examiner

DISPLAY CONTAINER

CROSS-REFERENCE TO RELATED APPLICATIONS

This application is a continuation of U.S. patent application Ser. No. 29/786,089, filed May 28, 2021, which is a divisional of U.S. patent application Ser. No. 29/669,649, filed Nov. 9, 2018 and issued as U.S. Pat. No. D923,475, each of which is hereby incorporated herein by reference in its entirety.

FIELD

The specification relates to display containers.

BACKGROUND

U.S. Pat. No. 9,630,747 B2 (Smith et al.) discloses a container for displaying, visualizing, and aroma sampling botanical materials—such as tea, cannabis, and the like including a container body, lid, and lens. The container body and the lid form an airtight seal. A sample may be visualized through the lens. In a preferred embodiment, the lid is shaped to define scent openings permitting aroma sampling of a sample contained within.

U.S. Pat. No. 9,334,086 B2 (Bean et al.) discloses a locking sample case used for displaying high-valued aromatic materials. The sample case has a stage for holding the material, a cover configured to mate with the stage, and a base to mate with the mated stage and cover assembly. The base has a lock mechanism to lock the stage to the base. The cover has tabs that secure the cover to the stage. The sample case is configured so that when the stage is mated to the base, the tabs cannot disengage from the base, so the cover cannot be removed from the stage when the stage is mated with the base. The cover has windows and closable vents to allow a potential buyer to see and smell the aromatic material. The sample case is configured to have a tether that can only be detached when the base is decoupled from the stage.

SUMMARY

The following summary is intended to introduce the reader to various aspects of the applicant's teaching, but not to define any invention.

According to some aspects, a display container includes: (a) an enclosure including a container body and a lid mounted to the container body for enclosing an interior chamber of the enclosure The lid has an integrated lens positioned over the interior chamber and one or more ports extending through the lid adjacent the lens. The display container further includes (b) a slide valve assembly for selectively opening and closing the one or more ports. The slide valve assembly includes a track fixed relative to the lid in alignment with the one or more ports, and a slide plate slidably received in the track. The slide plate is slidable back and forth along the track between a first position in which the slide plate blocks the one or more ports and a second position in which the one or more ports are unblocked.

In some examples, the slide valve assembly includes a tab fixed to and projecting transversely from the slide plate for operating the slide valve assembly.

In some examples, the tab extends through a slot fixed relative to the lid, the slot having at least one stop surface for engagement with the tab to limit movement of the slide plate past at least the second position.

In some examples, the tab projects from the slide plate to a distal end positioned outboard the lid for engagement by a user.

In some examples, the lid includes a generally planar top wall and a sidewall extending downwardly from a periphery of the top wall to a lower peripheral edge of the lid, and wherein the lens and the one or more ports are in the top wall.

In some examples, the lens is off centered toward a first side of the lid, and the slide valve assembly is between the lens and a second side of the lid, the second side opposite the first side.

In some examples, each of the container body and the lid is formed of a generally transparent material.

In some examples, the slide plate is formed of a generally transparent material.

In some examples, the lens is generally circular, and the track and slide plate are generally arcuate and curve in a direction generally about the lens.

In some examples, the track defines a channel in which the slide plate is received.

In some examples, the slide valve assembly includes a spring biasing the slide plate toward the first position.

In some examples, the slide plate is clear of the one or more ports when in the second position.

In some examples, the slide valve assembly is on an exterior of the lid overtop the one or more ports.

In some examples, the one or more ports comprise a plurality of ports.

According to some aspects, a display container includes: (a) an enclosure including a container body and a lid mounted to the container body for enclosing an interior chamber of the enclosure. Each of the container body and the lid is formed of a generally transparent material. The lid has an integrated lens positioned over the interior chamber, and a plurality of ports extending through the lid adjacent the lens. The display container further includes (b) a slide valve assembly for selectively opening and closing the ports. The slide valve assembly includes: (i) a track fixed relative to the lid in alignment with the ports, and (ii) a slide plate slidably received in the track. The slide plate is slidable back and forth along the track between a first position in which the slide plate blocks the ports and a second position in which the ports are unblocked. The slide valve assembly further includes (iii) a tab fixed to the slide plate for operating the slide valve assembly. The tab projects transversely from the slide plate, through a slot fixed relative to the lid, and to a distal end of the tab for engagement by a user. The slot has at least one stop surface for engagement with the tab to limit movement of the slide plate past at least the second position.

In some examples, the distal end of the tab is outboard the lid.

In some examples, the lid includes a generally planar top wall and a sidewall extending downwardly from a periphery of the top wall to a lower peripheral edge of the lid. The lens and the one or more ports are in the top wall.

In some examples, the lens is generally circular and off centered toward a first side of the lid, and the slide valve assembly is between the lens and a second side of the lid. The second side is opposite the first side. In some examples, the track and slide plate are generally arcuate and curve in a direction generally about the lens.

In some examples, the slide plate is formed of a generally transparent material.

In some examples, the track defines a channel in which the slide plate is received.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
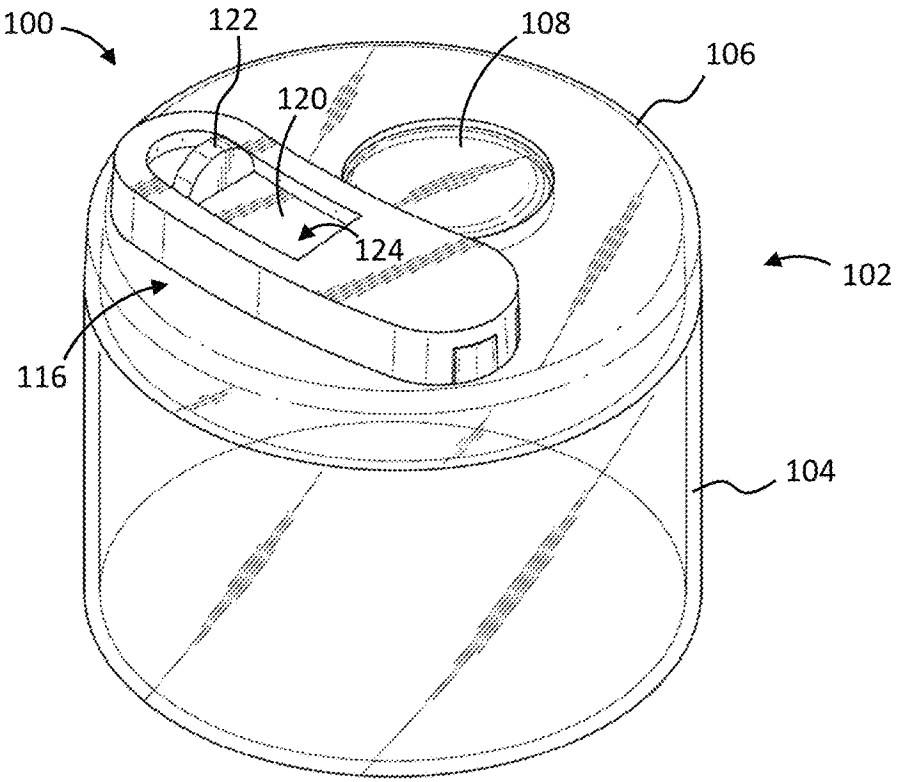
FIG. 1 is a perspective view of an example display container, with a slide valve assembly of the container shown in a closed configuration.

Referring to FIG. 1, an example display container 100 is shown. In the example illustrated, the display container 100 includes an enclosure 102 having a container body 104 and a lid 106 mounted to the container body 104 for enclosing an interior chamber of the enclosure 102. In the example illustrated, each of the container body 104 and the lid 106 is formed of a generally transparent material.

Figure 2:
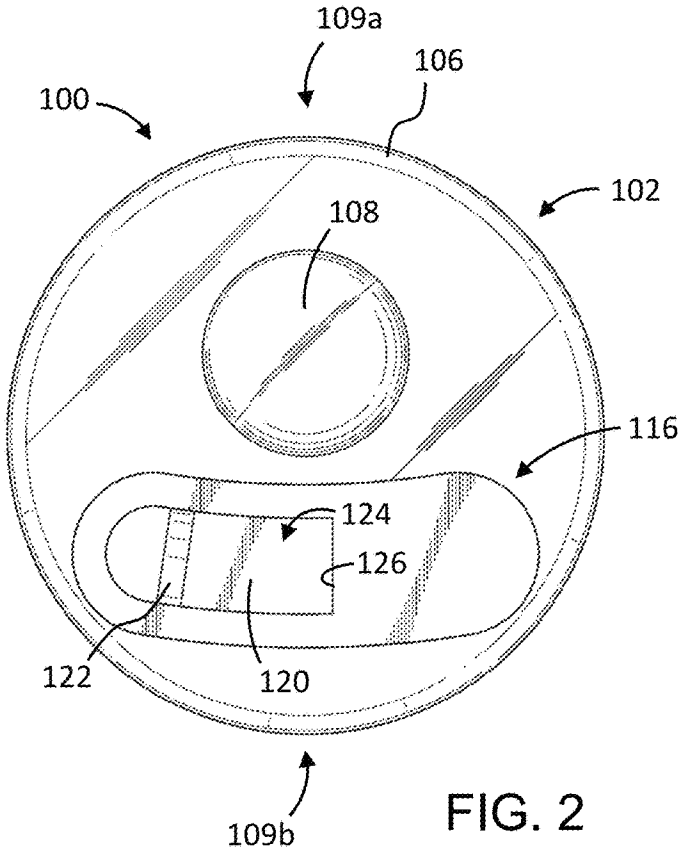
FIG. 2 is a top view of the display container of FIG. 1.

In the example illustrated, the lid 106 has an integrated lens 108 positioned over the interior chamber. Referring to FIG. 2, in the example illustrated, the lens 108 is generally circular, and is off centered toward a first side 109*a* of the lid 106.

Figure 3:
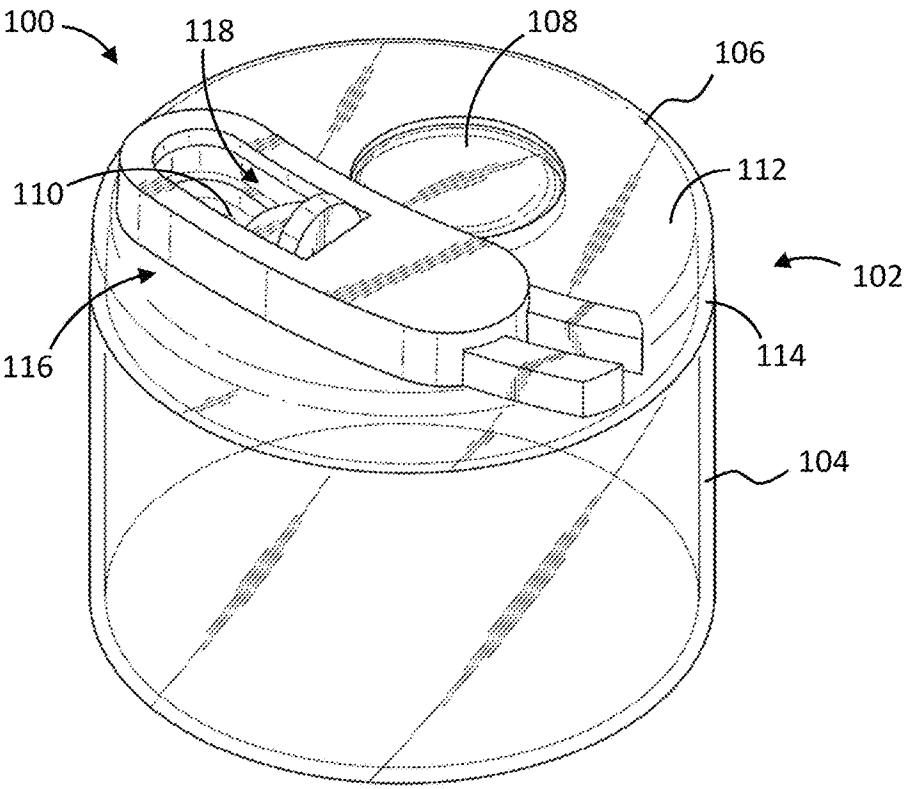
FIG. 3 is another perspective view of the display container of FIG. 1, but showing the slide valve assembly in an open configuration.
Figure 4:
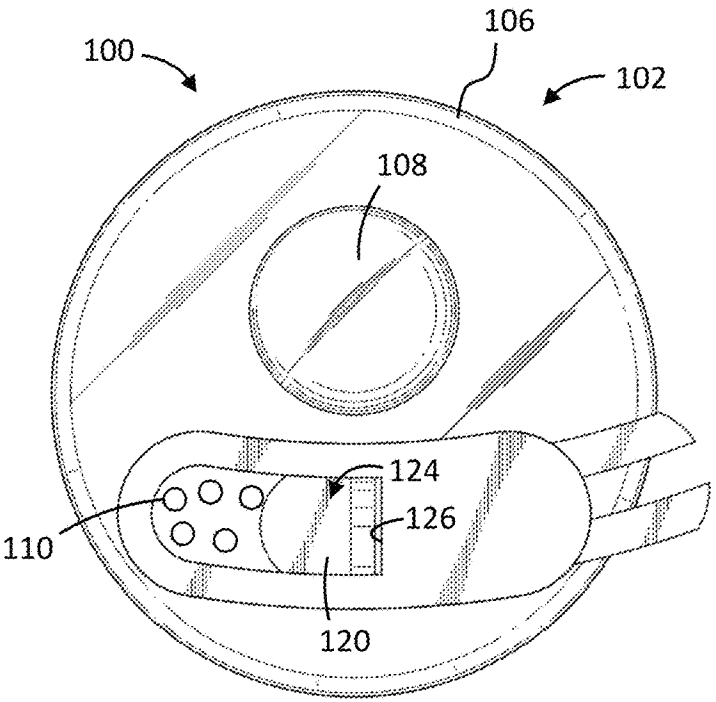
FIG. 4 is a top view of the display container of FIG. 3.

Referring to FIG. 4, in the example illustrated, at least one port 110 extends through the lid 106 adjacent the lens 108. In the example illustrated, the lid 106 has a plurality of ports 110. Referring to FIG. 3, in the example illustrated, the lid 106 includes a generally planar top wall 112 and a sidewall 114 extending downwardly from a periphery of the top wall 112 to a lower peripheral edge of the lid 106. The lens 108 and the ports 110 are in the top wall 112. In the example illustrated, the top wall 112 is generally circular.

In the example illustrated, the display container 100 further includes a slide valve assembly 116 for selectively opening and closing the ports 110. In the example illustrated, the slide valve assembly 116 is on an exterior of the lid 106 overtop the ports 110.

In the example illustrated, the slide valve assembly 116 includes a track 118 fixed relative to the lid 106 in alignment with the ports 110 and a slide plate 120 slidably received in the track 118. In the example illustrated, the track 118 defines a channel in which the slide plate 120 is received.

In the example illustrated, the slide plate 120 is slidable back and forth along the track 118 between a first position and a second position. Referring to FIGS. 1 and 2, when in the first position, the slide plate 120 blocks the ports 110. In the example illustrated, the slide plate 120 extends across the ports 110 when in the first position. Referring to FIGS. 3 and 4, when the slide plate 120 is the second position, the ports 110 are unblocked. In the example illustrated, the slide plate 120 is clear of the ports 110 when in the second position. Referring to FIG. 2, in the example illustrated, the ports 110 and the slide valve assembly 116 are between the lens 108 and a second side 109*b* of the lid 106. The second side 109*b* is opposite the first side 109*a* of the lid 106. Referring to FIGS. 1 and 2, in the example illustrated, the track 118 and the slide plate 120 are generally arcuate and curve in a direction generally about the lens 108.

Figure 6:
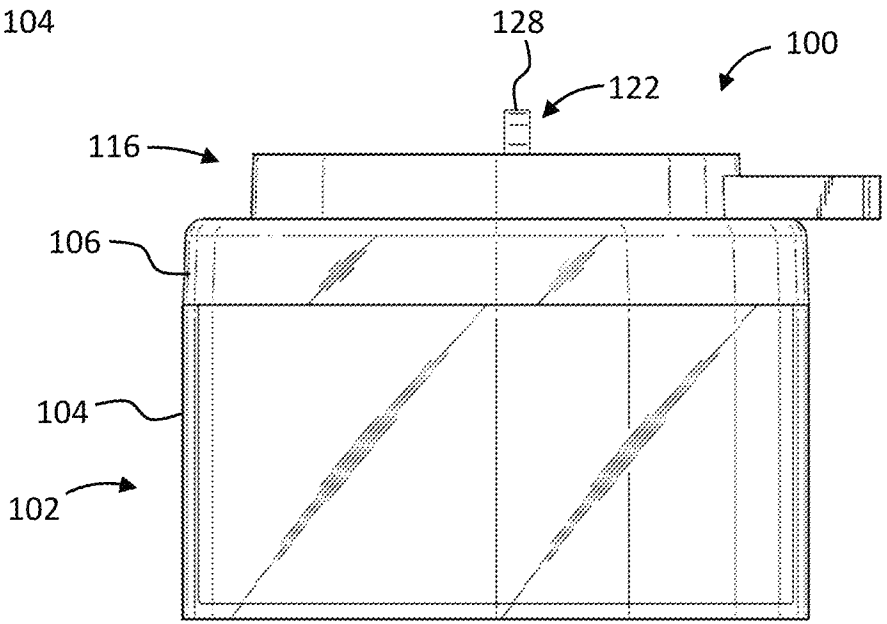
FIG. 6 is a side view of the display container of FIG. 3.
Figure 5:
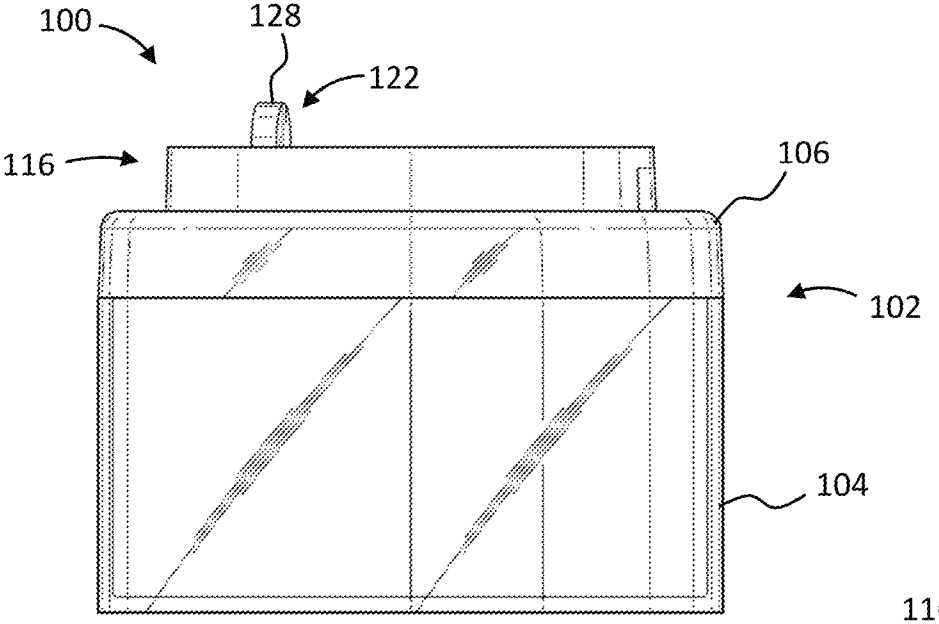
FIG. 5 is a side view of the display container of FIG. 1.
Figure 7:
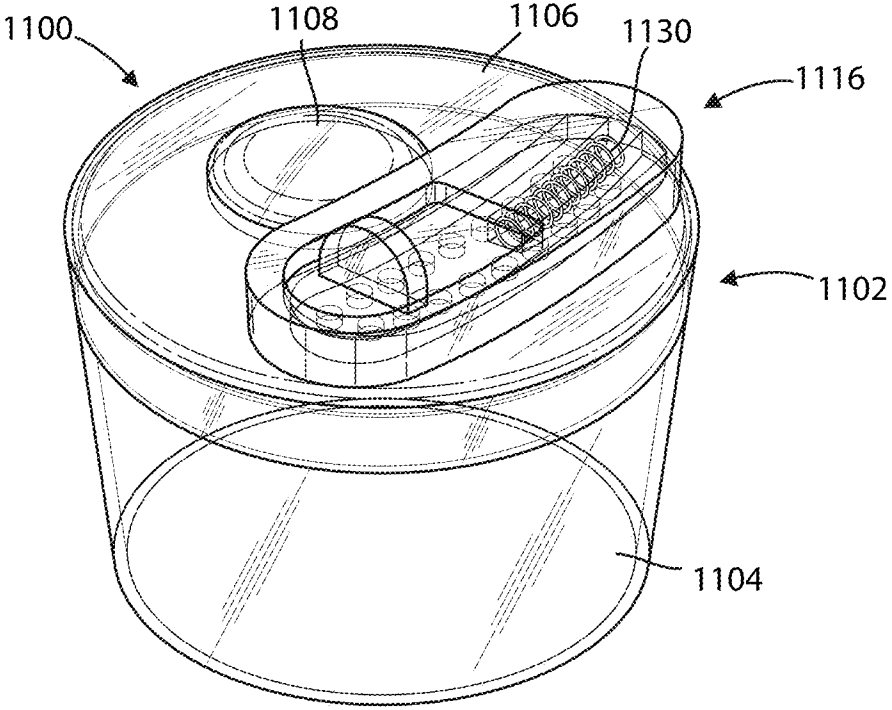
FIG. 7 is a perspective view of another example display container, with a slide valve assembly of the container shown in a closed configuration.
Figure 8:
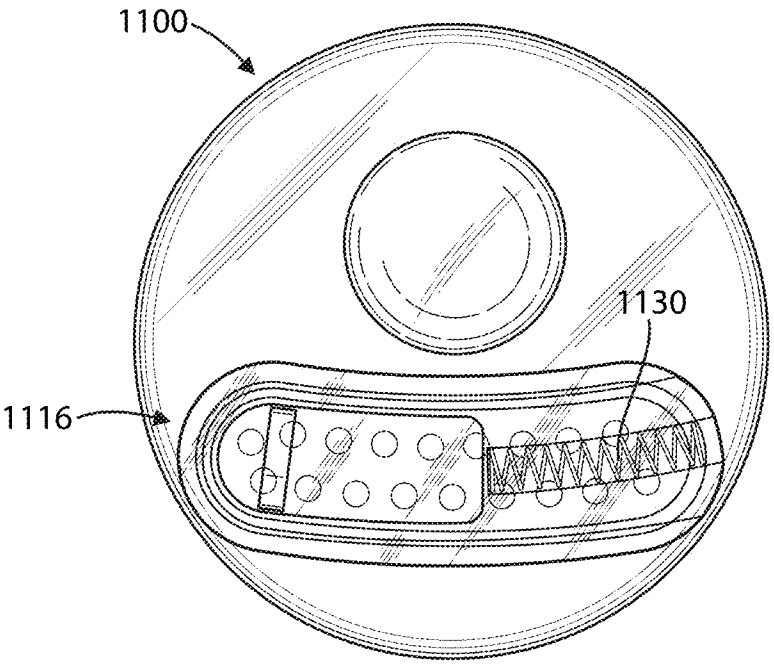
FIG. 8 is a top view of the display container of FIG. 7.

In the example illustrated, the slide valve assembly 116 includes a tab 122 fixed to and projecting transversely from the slide plate 120 for operating the slide valve assembly 116. In the example illustrated, the tab 122 extends through a slot 124 fixed relative to the lid 106. The slot 124 has at least one stop surface 126 for engagement with the tab 122 to limit movement of the slide plate 120 past at least the second position. Referring to FIGS. 5 and 6, in the example illustrated, the tab 122 projects from the slide plate 120 to a distal end 128 of the tab 122. The distal end 128 is positioned outboard the lid 106 for engagement by a user.

Figure 10:
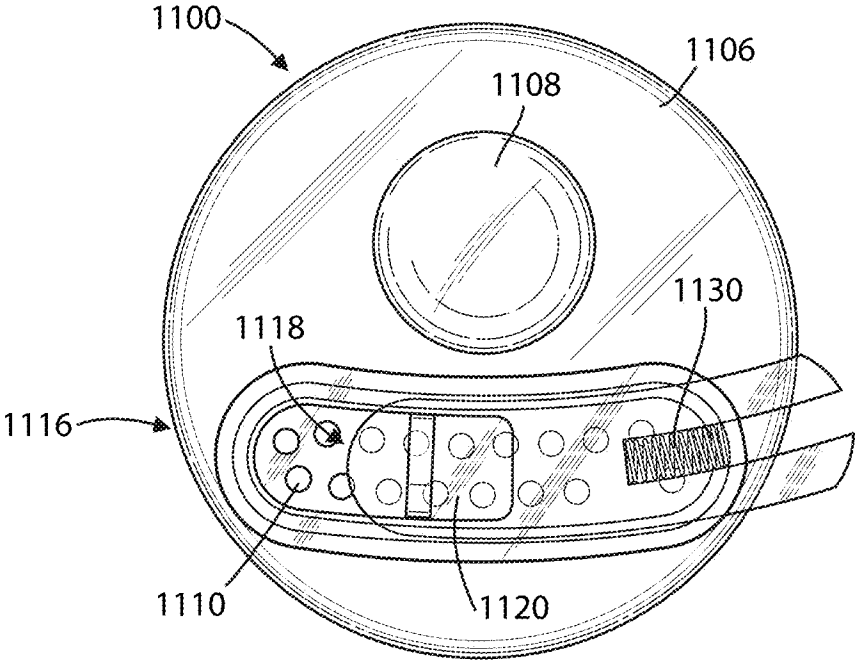
FIG. 10 is a top view of the display container of FIG. 9.
Figure 9:
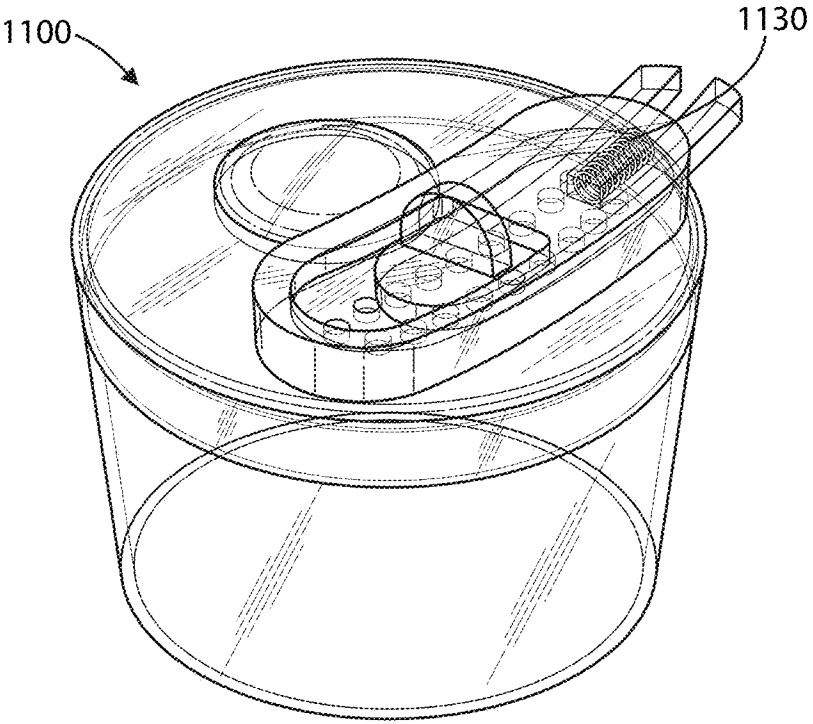
FIG. 9 is another perspective view of the display container of FIG. 7, but showing the slide valve assembly in an open configuration.

Referring to FIGS. 7-10, another example display container 1100 is illustrated. The display container 1100 has similarities to the display container 100, and like features are identified using like reference characters, incremented by 1000. In the example illustrated, the display container 1100 includes an enclosure 1102 having a container body 1104 and a lid 1106 mounted to the container body 1104. Referring to FIG. 10, the lid 1106 has an integrated lens 1108 and a plurality of ports 1110. The display container 1100 further includes a slide valve assembly 1116 having a slide plate 1120 slidable back and forth along a track 1118, between a first position (FIG. 8) in which the slide plate 1120 blocks the ports 1110 and a second position (FIG. 10) in which the ports 1110 are unblocked. In the example illustrated, the slide valve assembly 1116 includes a spring 1130 biasing the slide plate 1120 toward the first position. In the example illustrated, the slide plate 1120 is formed of a generally transparent material.

Figure 11:
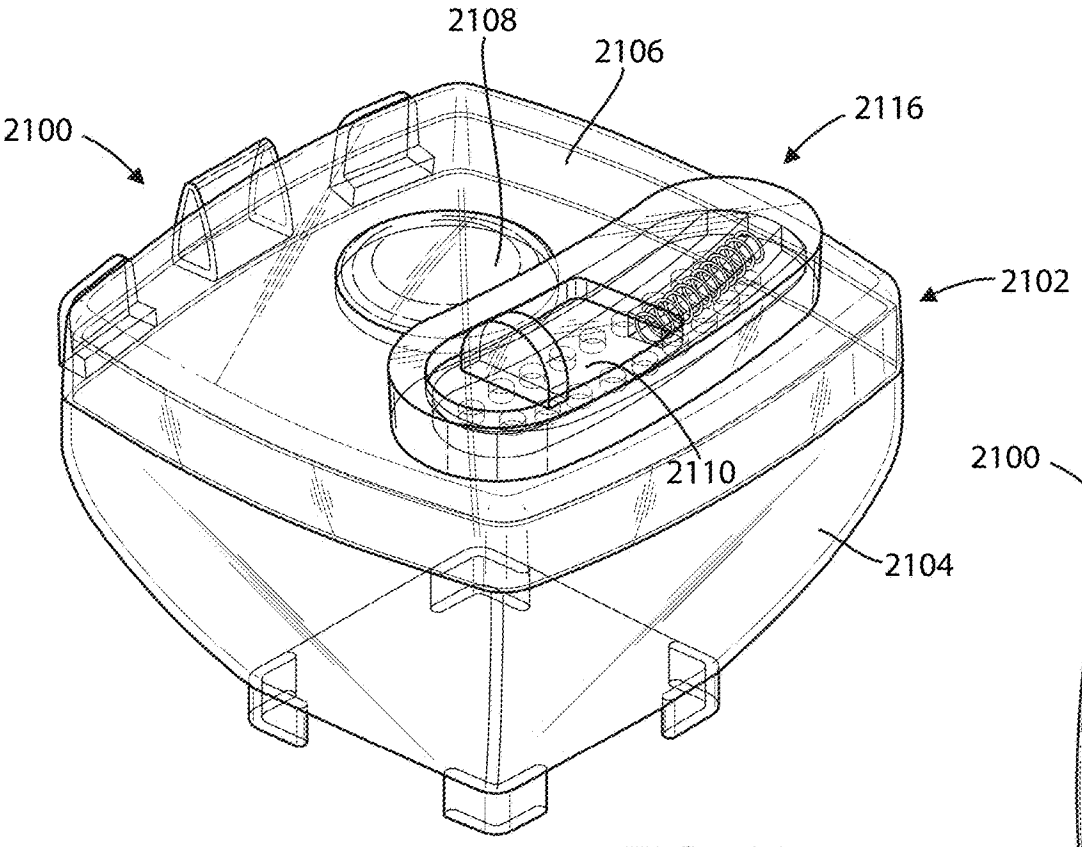
FIG. 11 is a perspective view of another example display container, with a slide valve assembly of the container shown in a closed configuration.
Figure 12:
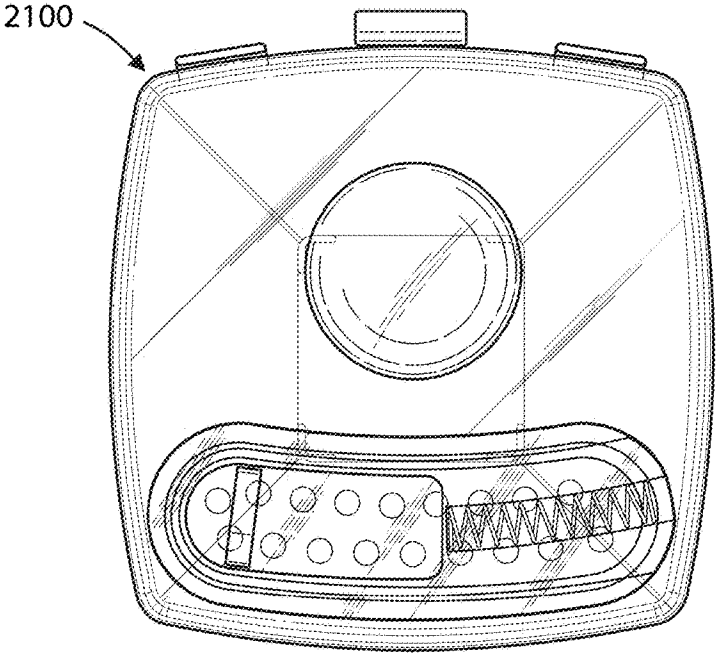
FIG. 12 is a top view of the display container of FIG. 11.
Figure 14:
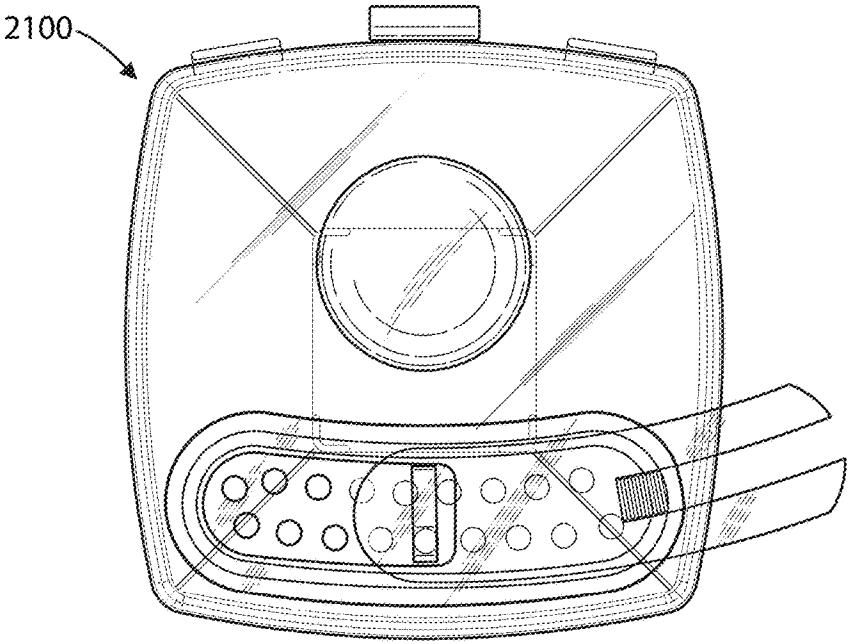
FIG. 14 is a top view of the display container of FIG. 13.
Figure 13:
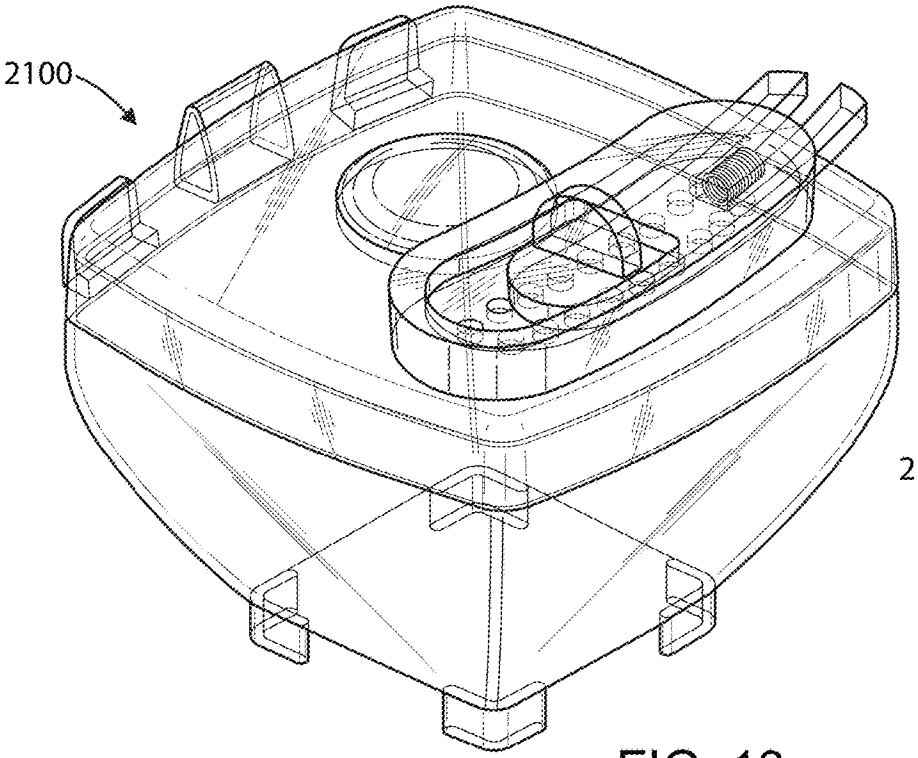
FIG. 13 is another perspective view of the display container of FIG. 11, but showing the slide valve assembly in an open configuration.

Referring to FIGS. 11-14, another example display container 2100 is illustrated. The display container 2100 has similarities to the display container 1100, and like features are identified using like reference characters, incremented by 1000. Referring to FIG. 11, in the example illustrated, the display container 2100 includes an enclosure 2102 having a container body 2104, a lid 2106 with an integrated lens 2108 and a plurality of ports 2110, and a slide valve assembly 2116. In the example illustrated, the lid 2106 has a generally rectangular shape.

The invention claimed is:

1. A display container, comprising:

a) an enclosure including a container body and a lid mounted to the container body for enclosing an interior chamber of the enclosure, the lid having an integrated lens positioned over the interior chamber and one or more ports extending through the lid adjacent the lens; and b) a slide valve assembly for selectively opening and closing the one or more ports, the slide valve assembly including a track fixed relative to the lid in alignment with the one or more ports, and a slide plate slidably received in the track, the slide plate slidable back and forth along the track between a first position in which the slide plate blocks the one or more ports and a second position in which the one or more ports are unblocked, and the slide valve assembly including a tab fixed to and projecting transversely from the slide plate for operating the slide valve assembly, the tab extending through a slot fixed relative to the lid, the slot having at least one stop surface for engagement with the tab to limit movement of the slide plate past at least the second position.

2. The display container of claim 1, wherein the tab projects from the slide plate to a distal end positioned outboard the lid for engagement by a user.

3. The display container of claim 1, wherein the lid includes a generally planar top wall and a sidewall extending downwardly from a periphery of the top wall to a lower peripheral edge of the lid, and wherein the lens and the one or more ports are in the top wall.

4. The display container of claim 1, wherein the lens is off centered toward a first side of the lid, and the slide valve assembly is between the lens and a second side of the lid, the second side opposite the first side.

5. The display container of claim 1, wherein each of the container body and the lid is formed of a generally transparent material.

6. The display container of claim 5, wherein the slide plate is formed of a generally transparent material.

7. The display container of claim 1, wherein the lens is generally circular, and the track and slide plate are generally arcuate and curve in a direction generally about the lens.

8. The display container of claim 1, wherein the track defines a channel in which the slide plate is received.

9. The display container of claim 1, wherein the slide valve assembly includes a spring biasing the slide plate toward the first position.

10. The display container of claim 1, wherein the slide plate is clear of the one or more ports when in the second position.

11. The display container of claim 1, wherein the slide valve assembly is on an exterior of the lid overtop the one or more ports.

12. The display container of claim 1, wherein the one or more ports comprise a plurality of ports.

13. A display container, comprising:

a) an enclosure including a container body and a lid mounted to the container body for enclosing an interior chamber of the enclosure, the container body and the lid formed of a generally transparent material, and the lid having an integrated lens positioned over the interior chamber, and a plurality of ports extending through the lid adjacent the lens; and b) a slide valve assembly for selectively opening and closing the ports, the slide valve assembly including:

i) a track fixed relative to the lid in alignment with the ports, ii) a slide plate slidably received in the track, the slide plate slidable back and forth along the track between a first position in which the slide plate blocks the ports and a second position in which the ports are unblocked; and iii) a tab fixed to the slide plate for operating the slide valve assembly, the tab projecting transversely from the slide plate, through a slot fixed relative to the lid, and to a distal end of the tab for engagement by a user, the slot having at least one stop surface for engagement with the tab to limit movement of the slide plate past at least the second position.

14. The display container of claim 13, wherein the distal end of the tab is outboard the lid for engagement by a user.

15. The display container of claim 13, wherein the lid includes a generally planar top wall and a sidewall extending downwardly from a periphery of the top wall to a lower peripheral edge of the lid, and wherein the lens and the one or more ports are in the top wall.

16. The display container of claim 15, wherein the lens is generally circular and off centered toward a first side of the lid, and the slide valve assembly is between the lens and a second side of the lid, the second side opposite the first side, and wherein the track and slide plate are generally arcuate and curve in a direction generally about the lens.

17. The display container of claim 13, wherein the slide plate is formed of a generally transparent material.

18. The display container of claim 13, wherein the track defines a channel in which the slide plate is received.

19. A display container, comprising:

a) an enclosure including a container body and a lid mounted to the container body for enclosing an interior chamber of the enclosure, the lid having an integrated lens positioned over the interior chamber and one or more ports extending through the lid adjacent the lens; and b) a slide valve assembly for selectively opening and closing the one or more ports, the slide valve assembly including a track fixed relative to the lid in alignment with the one or more ports, and a slide plate slidably received in the track, the slide plate slidable back and forth along the track between a first position in which the slide plate blocks the one or more ports and a second position in which the one or more ports are unblocked, and the slide plate having a leading edge sweeping an area across the one or more ports when moving from the first position to the second position, and the slide valve assembly including a spring biasing the slide plate toward the first position, the spring positioned clear of the area swept by the leading edge of the slide plate.

20. The display container of claim 19, wherein the spring comprises a compression spring and is compressed when the slide plate is moved toward the second position for urging the slide pate back toward the first position.

21. The display container of claim 19, wherein the spring is enclosed and generally concealed within an interior of the slide valve assembly.

* * * * *